United States Patent [19]

Albach et al.

[11] Patent Number: 4,812,736

[45] Date of Patent: Mar. 14, 1989

[54] CIRCUIT ARRANGEMENT FOR OPERATING HIGH-PRESSURE GAS DISCHARGE LAMPS

[75] Inventors: Manfred Albach; Ralf Schäfer, both of Aachen; Hans-Peter Stormberg, Stolberg; Armin Wegener, Aachen, all of Fed. Rep. of Germany

[73] Assignee: U.S. Philips Corp., New York, N.Y.

[21] Appl. No.: 880,855

[22] Filed: Jul. 1, 1986

[30] Foreign Application Priority Data

Jul. 6, 1985 [DE] Fed. Rep. of Germany ..... 3524266

[51] Int. Cl.[4] ..... G05F 1/56

[52] U.S. Cl. ..... 323/224; 323/266; 363/89; 315/DIG. 7

[58] Field of Search ..... 323/222, 224, 285, 286, 323/287, 266; 363/89; 315/299, 301, 306, DIG. 7

[56] References Cited

U.S. PATENT DOCUMENTS

| | | | |
|---|---|---|---|
| 3,890,537 | 6/1975 | Park et al. | 315/DIG. 7 X |
| 4,042,856 | 8/1977 | Steigerwald | 323/282 X |
| 4,459,537 | 7/1984 | McWhorter | 323/224 |
| 4,481,460 | 11/1984 | Kröning et al. | 323/266 |

FOREIGN PATENT DOCUMENTS

| | | | |
|---|---|---|---|
| 0059053 | 9/1982 | European Pat. Off. . | |
| 0452816 | 5/1975 | U.S.S.R. | 323/222 |
| 0985774 | 1/1983 | U.S.S.R. | 363/89 |

OTHER PUBLICATIONS

Conference: Intelec '81, Third International Telecommunications Energy Conference, Grossoni et al, London, England, May 19–21, 1981, pp. 282–287.

*Primary Examiner*—Patrick R. Salce
*Assistant Examiner*—Kristine Peckman
*Attorney, Agent, or Firm*—Bernard Franzblau

[57] ABSTRACT

A circuit for operating high-pressure gas discharge lamps comprises a full-wave rectifier (2) which is connected to an alternating voltage supply source and supplies an output direct voltage to a combinatorial circuit part comprising a switching transistor (3), a choke coil (4), a fly-wheel diode (5) and a storage capacitor (6), from which the lamp is energized. A further combinatorial circuit part (7, 8, 10, 11) comprises at least one electronic circuit element (7) coupled between the storage capacitor (6) and the lamp (9) and is controlled by a control device (12). The control device compares an instantaneous lamp current of higher frequency with a nominal-value signal composed of a sinusoidal voltage component having double the supply frequency and a d.c. voltage component having a value of at least the maximum amplitude of the sinusoidal voltage.

14 Claims, 4 Drawing Sheets

CIRCUIT ARRANGEMENT FOR OPERATING HIGH-PRESSURE GAS DISCHARGE LAMPS

BACKGROUND OF THE INVENTION

This invention relates to a circuit arrangement for operating at least one high-pressure gas discharge lamp at a current of higher frequency, which comprises a full-wave rectifier for connection to an alternating voltage source and having direct voltage output terminals connected to a first circuit part comprising a switching transistor, a choke coil, a fly-wheel diode and a storage capacitor for feeding the lamp. The duty cycle and/or the switching frequency of the switching transistor are controlled by a control device in such a manner such that the current load on the alternating voltage source is as sinusoidal as possible.

The term "current of higher frequency" is to be understood herein to mean a current of a periodically varying value having a frequency between 1 kHz and 500 kHz and preferably between 20 kHz and 150 kHz.

Such a circuit arrangement comprising, for example, a boost or up converter as the first circuit part is known from EP OS No. 0059053. In general, storage capacitors in comparatively high capacitance are used, for example, 220 $\mu$F/400 V with a power consumption of the lamp of 130 W. In order to guarantee a minimum life of the storage capacitors, a comparatively large number of electrolytic capacitors is required. Otherwise, the capacitors would be heated excessively due to the high-frequency current pulses. Therefore, it would be desirable to use foil capacitors for the storage capacitors. In the known circuit arrangements, however, this solution would have the disadvantage that due to their low storage capacity per unit volume, no constant direct voltage, but a direct voltage pulsating at double the mains frequency occurs at the storage capacitor. However, only a small direct voltage fluctuation is often desirable. The control for a usually employed boost or up converter is very simple if a constant output direct voltage is presupposed. On the other hand, not too large a voltage fluctuation is also favourable for the operation of high-pressure gas discharge lamps because these lamps extinguish at voltages below their operating voltage. The reignition of high-pressure gas discharge lamps is only possible, however, if shortly after the lamp has extinguished again a sufficient voltage (re-ignition voltage) is available at the storage capacitor.

SUMMARY OF THE INVENTION

Therefore, an object of the invention is to provide a circuit arrangement for operating at least one high-pressure gas discharge lamp in which, on the one hand, a source load as sinusoidal as possible is obtained with low inherent losses and, on the other hand, a small storage capacitor is sufficient and with a small voltage fluctuation developed across this storage capacitor.

According to the invention, in a circuit arrangement of the kind mentioned in the opening paragraph this object is achieved in that a second circuit part comprising at least one electronic switching element is arranged between the storage capacitor and the lamp which can be controlled by a control device upon comparison of an actual-value signal proportional to the instantaneous lamp current of higher frequency with a nominal-value signal consisting of a sinusoidal voltage having double the alternating voltage source frequency and of a d.c. voltage component having a value of at least the maximum amplitude of the sinusoidal voltage.

Such a circuit arrangement produces a lamp current, which modulates a high-frequency component which depends upon the switching frequency of the electronic switching element and whose frequency usually lies between 1 and 500 kHz and preferably between 20 and 150 kHz. The lamp current pulsates at the rhythm of double the source frequency, to which a d.c. component is added. The required nominal-value signal part $\sin^2 \omega t$ is then preferably formed from the voltage $|\sin \omega t|$ which is present behind the full-wave rectifier and in whose Fourier development as a $1^{st}$ harmonic the function $\cos^2 \omega t$ is contained. According to the formula $\sin^2 \omega t = \frac{1}{2}(1-\cos^2 \omega t)$, the square of the sine can be formed therefrom by superimposing on it a d.c. component.

The term "circuit part" is to be understood herein to mean any type of converter, such as, for example, a buck or down converter, a boost or up converter, a buck-boost converter, a fly-back converter, a forward converter, a push-pull converter, a bridge converter etc. In an advantageous further embodiment of the circuit arrangement according to the invention, an opto-coupler is connected to the full-wave rectifier for forming the nominal-value signal from the rectified source voltage through an RC combination.

In another advantageous embodiment according to the invention, the second combinatorial circuit part is a buck or down converter, and the nominal-value signal is formed from a voltage drop at the electronic switching element through an RC combination.

BRIEF DESCRIPTION OF THE DRAWINGS

In order that the invention may be readily carried out, it will now be described more fully, by way of example, with reference to the accompanying drawing, in which.

DESCRIPTION OF THE PREFERRED EMBODIMENTS

Figure 1:
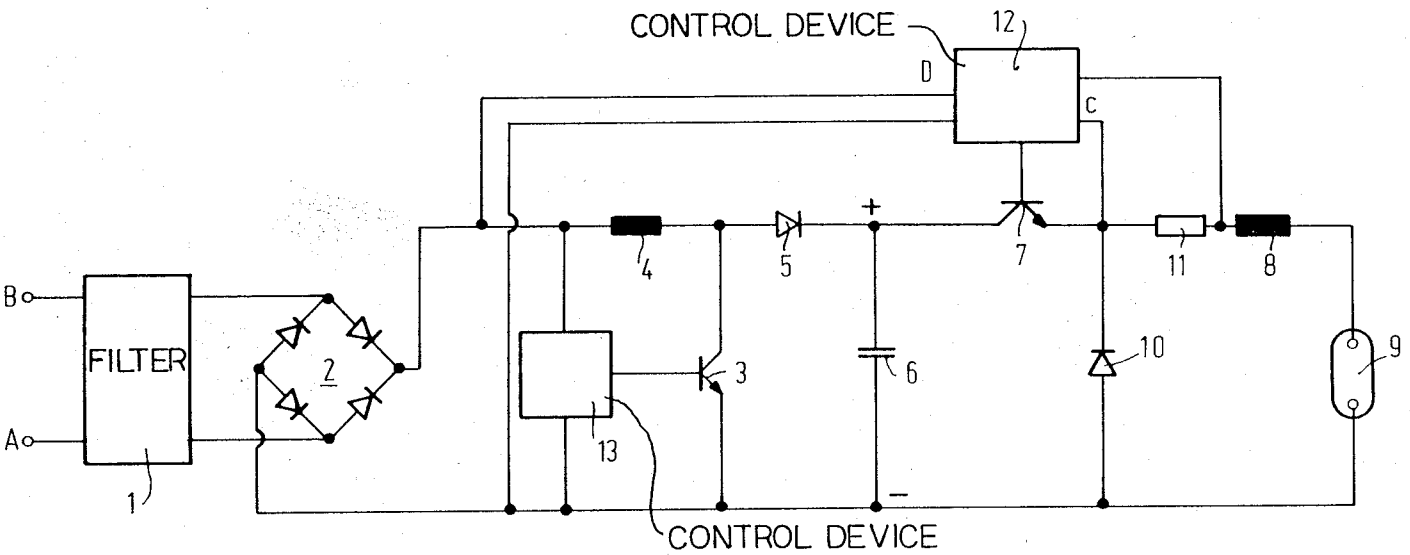
FIG. 1 shows a circuit arrangement for operating at least one high-pressure gas discharge lamp comprising an up converter which is controlled through a control device, and which is followed by a down converter controlled through a control device.

In FIG. 1, A and B designate input terminals for connection to a mains voltage supply of, for example, 220 V, 50 Hz serving as an alternating voltage source. A full-wave rectifier 2 comprising four diodes is connected to the input terminals A and B through a high-frequency filter 1. An up converter comprising a switching transistor 3, a choke coil 4, a fly-wheel diode 5 and a storage capacitor 6 and serving as the first combinatorial circuit part is connected to the outut direct voltage terminals of the full-wave rectifier 2. A direct voltage of at most 400 V is applied to the storage capacitor 6, which has a comparatively small capacitance of, for example, 1.5 μF.

A down converter serving as the second circuit part and comprising an electronic switching element 7 in the form of a second switching transistor, a choke coil 8 and a fly-wheel diode 10 is connected parallel to the storage capacitor 6. A connected lamp 9 is shown coupled to the down converter. The lamp circuit further includes a measuring resistor 11 which acts as a current sensor and across which an actual-value signal is derived. This signal is proportional to the instantaneous lamp current and is fed to the input C of a control device 12. The lamp current I is tracked through the control device 12 in a manner to be described below by a nominal-value signal derived from the rectified mains voltage and applied to the input D of the control device 12.

A control device 13 for controlling the duty cycle and/or the switching frequency of the switching transistor 3 operates in such a manner that the current drawn from the alternating voltage mains varies as sinusoidally as possible. Such control devices are known per se, for example, from DE OS No. 2652275.

Figure 4:
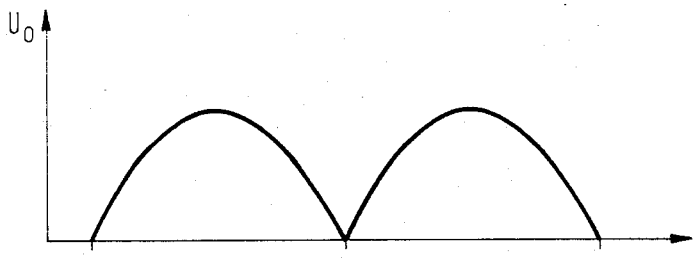
FIG. 4 shows the voltage variation at the output of the full-wave rectifier of the circuit arrangement shown in FIG. 1.
Figure 5:
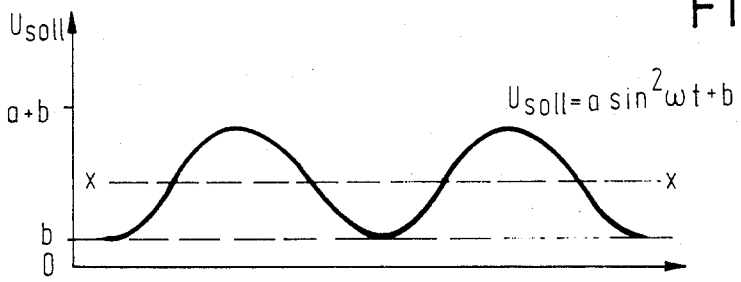
FIG. 5 shows the variation of the nominal-value signal in the circuit arrangements shown in FIGS. 2 and 3.

The control device 12 serves to keep the voltage fluctuation at the storage capacitor 6 as small as possible. An embodiment of the control device 12 will now be described more fully with reference to FIG. 2. A sinusoidal voltage having double the mains frequency is formed from the voltage $U_o = |\sin \omega t|$ (FIG. 4) which appears at the direct voltage output terminals of the full-wave rectifier 2. This sinusoidal voltage is formed by means of a resistor 14, an opto-coupler 15 and a variable resistor 16 and a capacitor 17 connected in parallel to. An RC combination comprising a variable resistor 18 and a capacitor 19 is operative to make the phase of the nominal-value signal, which is ultimately applied to the inputs of the comparators 20 and 21, correspond to the phase of the mains voltage. A capacitor 22 serves to cut off the d.c. component, which can be arbitrarily adjusted by means of a variable resistor 23. Thus, it can be achieved that a nominal-value signal $U_{soll} = a \sin^2 \omega t + b$ can be supplied to the inputs of the comparators 20 and 21 (FIG. 5). The constant b may of course also become zero. The nominal-value signal $U_{soll}$ consists of a sinusoidal signal having duble the mains frequency and a d.c. component having a value of at least the maximum amplitude a/2 of the sinusoidal signal. In FIG. 5, the d.c. component is indicated by the broken line x—x.

By means of a variable resistor 24, an upper limit level can be adjusted at the comparator 20. By means of resistors 25 and 26, a lower limit level can be adjusted at the comparator 21. Capacitors 33 and 34 serve to suppress high-frequency interference signals. The actual value signal proportional to the lamp current and derived at the measuring resistor 11 is divided through a capacitor 27 and a potentiometer 28 and is supplied to the comparators 20 and 21. The output signals of the comparators 20 and 21 are supplied to the reset input R and to the set input S, respectively, of a bistable trigger circuit 29. The signal at the output F of the bistable trigger circuit 29 now switches the transistor 7 to the conducting state and the non-conducting state, respectively.

A stabilized direct voltage of, for example, 12 V applied to the point G can adjust the system automatically and is used for the voltage supply of the electronic system and is supplied through resistors 30 and 31 to the outputs of the comparators 20 and 21.

Figure 6:
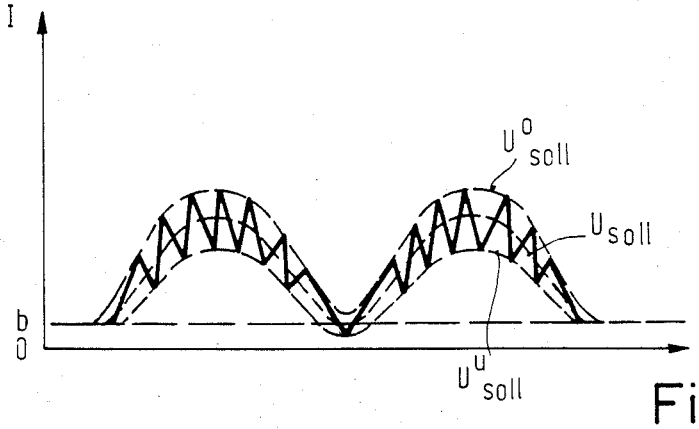
FIG. 6 shows the current variation through the lamp.

The control device 12 then operates in such a manner that, when an upper nominal-value level $U^o_{soll}$ is reached, the switching transistor 7 is switched to the non-conducting state; when a lower nominal-value level $U^u_{soll}$ is reached, the transistor 7 is switched again to the conducting state (FIG. 6). The switching frequency of the switching transistor 7 varies during the 100 Hz periods, but preferably lies between 20 and 150 kHz, in accordance with the size of the choke coil 8. FIG. 6 shows the variation of the lamp current I, which mainly corresponds to the variation of the nominal-value signal shown in FIG. 5, on which the switching frequency of the switching transistor 7 is superimposed.

During operation of a 50 W mercury high-pressure lamp, it can be achieved with this embodiment that the voltage fluctuation at the storage capacitor 6 is smaller than 60 V. This at the same time leads to a purely sinusoidal mains current. However, when, as known, a constant direct voltage is chosen as the actual-value level, a voltage fluctuation of substantially 400 V is obtained, which leads with the same up converter to considerable mains distortions. In order to avoid this, in this kind of control, a considerably larger capacitor 6 should be used (about 10 μF).

Figure 2:
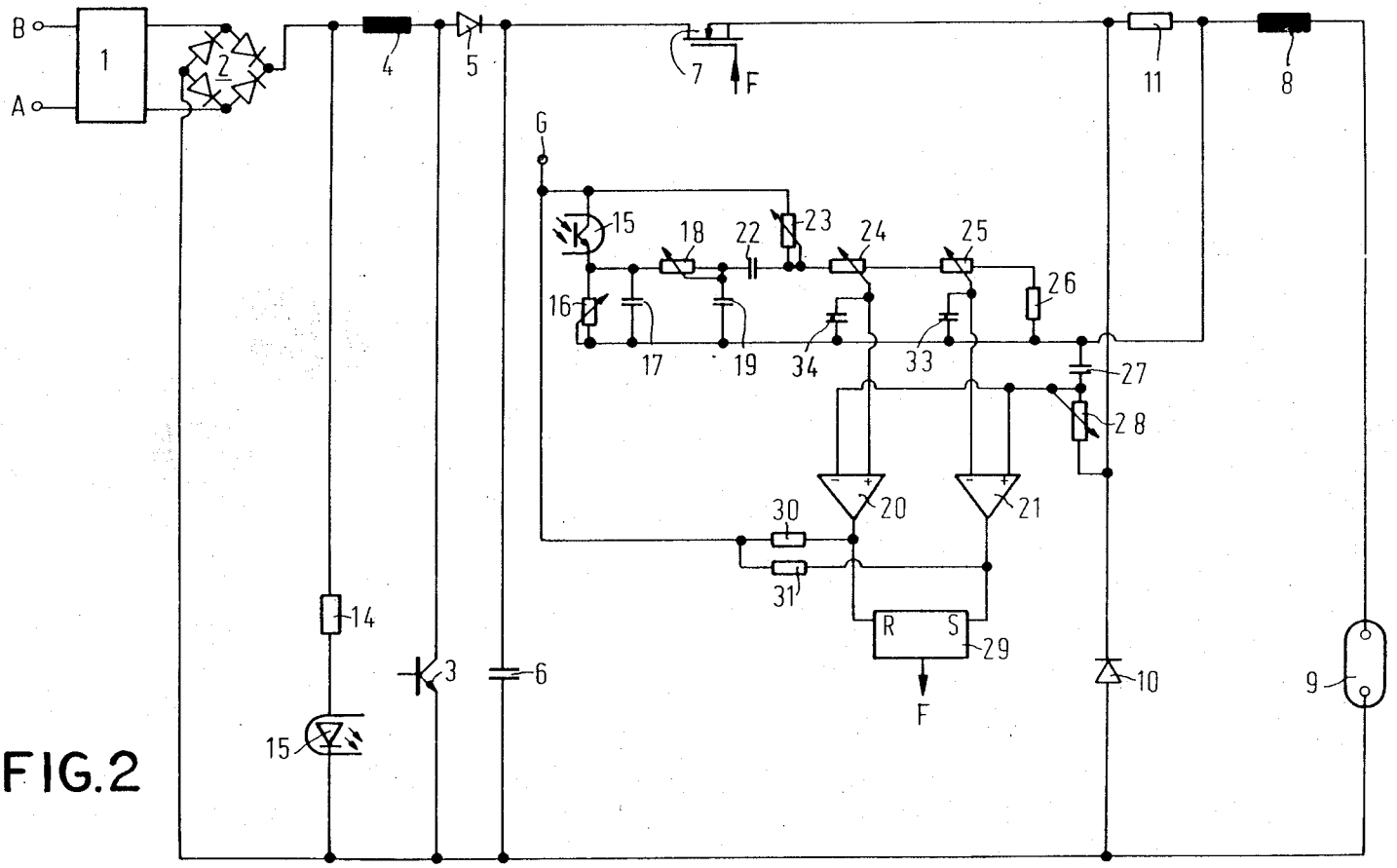
FIG. 2 shows the circuit diagram of the control device used in the circuit arrangement shown in FIG. 1.
Figure 3:
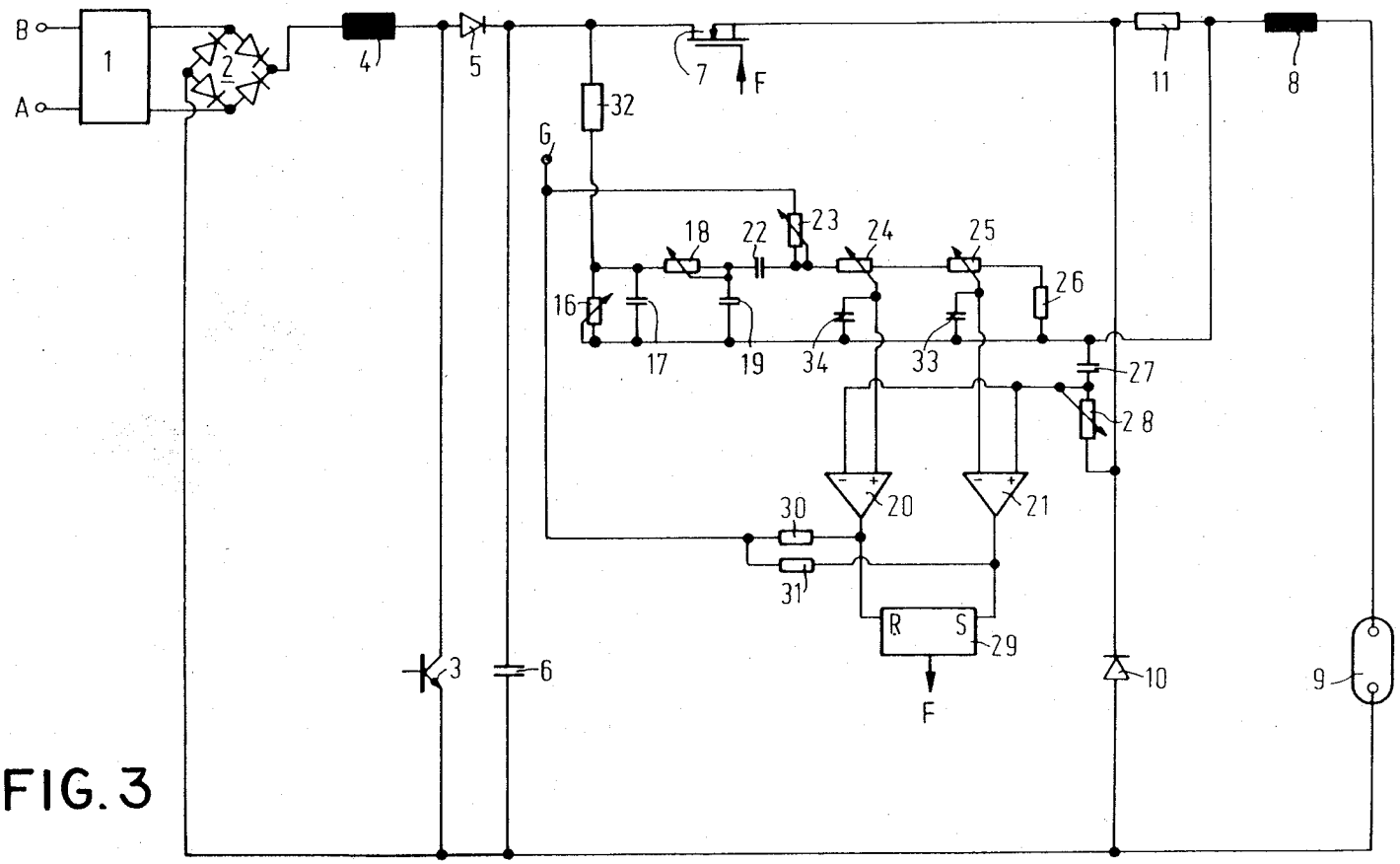
FIG. 3 shows the circuit diagram of another control device.

The control device 12 shown in FIG. 3 mainly corresponds to the device shown in FIG. 2. However, instead of using the opto-coupler, the nominal-value signal is formed from a voltage drop at the switching transistor 7 in that a voltage is derived across the switching transistor 7 and the measuring resistor 11 and this voltage is supplied to the variable resistor 16 via a resistor 32.

In a practical embodiment comprising a control device as shown in FIG. 2 for operating a 50 W high-pressure mercury lamp having a lamp operating voltage of about 90 V at a mains alternating voltage of 220 V, 50 Hz, and a voltge at the storage capacitor 6 of at most 400 V, the following circuit elements were used:

| | | |
|---|---|---|
| Resistor 11 | 1 Ohm | |
| Resistor 14 | 100 kOhm | |
| Resistor 16 | 47 kOhm | |
| Resistor 18 | 22 kOhm | |
| Resistor 23 | 1 MOhm | |
| Resistor 24 | 4.7 kOhm | |
| Resistor 25 | 4.7 kOhm | |
| Resistor 26 | 4.7 kOhm | |
| Resistor 28 | 1 kOhm | |
| Resistor 30 | 33 kOhm | |
| Resistor 31 | 33 kOhm | |
| Capacitor 6 | 1.5 μF 400 V | |
| Capacitor 17 | 100 nF | |
| Capacitor 19 | 100 nF | |
| Capacitor 22 | 220 nF | |
| Capacitor 27 | 33 nF | |
| Capacitor 33 | 10 nF | |
| Capacitor 34 | 10 nF | |
| Choke coil 4 | 1 mH | |
| Choke coil 8 | 1 mH | |
| Diode 5 | BY 229 Valvo | |
| Diode 10 | DSR 5500x TRW | |
| Opto coupler 15 | CNY 62 | |
| Comparators 20, 21 | 2x ½ LM339 | Valvo |
| bistable trigger circuit 29 | HEF 4027 | |

What is claimed is:

1. A circuit for operating at least one high-pressure gas discharge lamp with a high frequency current comprising, a full-wave rectifier to be connected to an alternating voltage source and having direct voltage output terminals connected to a first circuit part comprising a switching transistor, a choke coil, a fly-wheel diode and a storage capacitor, for feeding a lamp, characterized in that a second circuit part comprising at least one electronic switching element is coupled between the storage capacitor and the lamp and is controlled by a control device that compares an actual-value signal proportional to an instantaneous lamp current of said high frequency with a nominal-value signal comprising a sinusoidal voltage having double the alternating voltage source frequency and a d.c. voltage component having a value of at least the maximum amplitude of the sinusoidal voltage.

2. A circuit as claimed in claim 1, further comprising an opto-coupler connected to the full-wave rectifier for forming the nominal-value signal from the rectified source voltage by means of an RC combination.

3. A circuit as claimed in claim 1, characterized in that the second circuit part comprises a buck or down converter, and in that the nominal-value signal is derived in an RC circuit that is responsive to a voltage drop developed across the electronic switching element.

4. A circuit for operating a high pressure gas discharge lamp with a fluctuating current of high frequency comprising, a full-wave rectifier having input terminals for connection to a source of AC voltage and having direct voltage output terminals, a first circuit part including an inductor and a switching transistor serially coupled across the rectifier direct voltage output terminals, said first circuit part further comprising a fly-wheel diode and a capacitor connected in series circuit to said switching transistor, a second circuit part comprising an electronic switching element coupling the capacitor to terminals for connection of a lamp, a control device having an output coupled to a control electrode of the electronic switching element for controlling the switching of said electronic switching element, said control device having first input means coupled to an actual-value signal proportional to an instantaneous lamp current of said high frequency and second input means coupled to a nominal-value signal comprising a sinusoidal voltage of double the AC voltage frequency and a DC voltage component of at least the maximum amplitude of the sinusoidal voltage, and said control device includes means for comparing the actual-value signal and the nominal-value signal to derive a switching control signal at its output.

5. A circuit as claimed in claim 4 wherein the second circuit part further comprises a second inductor connected in a second series circuit with the electronic switching element, and a second flywheel diode coupled to a circuit point in the second series circuit and to a common circuit point coupled to one output terminal of the full wave rectifier and to that one of the lamp connection terminals that is remote from the second inductor, said first and second circuit parts connected to operate as an up converter and a down converter, respectively.

6. A circuit as claimed in claim 4 further comprising a resistor connected in series with the electronic switching element and the lamp connection terminals and connected to said control device first input means for deriving said actual-value signal.

7. A circuit as claimed in claim 4 wherein a voltage of said high frequency is produced across said electronic switching element, and further comprising an RC circuit responsive to said high frequency voltage for deriving said nominal-valve signal.

8. A circuit as claimed in claim 4 wherein the flywheel diode is polarized to prevent the capacitor from discharging via the switching transistor.

9. A circuit for supplying a stable high-frequency current to a pair of load terminals comprising, a pair of input terminals for a time varying unidirectional voltage of double the frequency of a source of low frequency AC supply voltage, a first part of said circuit including an up-converter coupled to said input terminals, said up-converter comprising a first switching transistor connected in series circuit with a first inductor across said input terminals and a flywheel diode coupling a storage capacitor to said series circuit so as to develop a voltage across the capacitor with a relatively small voltage fluctuation of said double frequency, a second part of said circuit comprising a down-converter coupled to the storage capacitor and to said load terminals, said down-converter including a second switching transistor and a second inductor connected in series between an electrode of the capacitor and a first one of the load terminals, said down-converter further comprising a second flywheel diode coupled to the second switching transistor and to a second one of the load terminals, and a control device having a first input that receives an actual-value signal proportional to the high frequency load current and a second input coupled to the input terminals and comprising means for deriving a nominal-value signal including a sinusoidal voltage component of said double frequency and a DC voltage component of an amplitude at least equal to the maximum amplitude of the sinusoidal voltage component, said control device including means for comparing said actual-value signal and said nominal-value signal to derive a high-frequency switching signal at an output of the control device, and means coupling said control device output to a control electrode of the second switching transistor so as to alternately drive the second switching transistor full-on and full-off at said high-frequency.

10. A circuit as claimed in claim 9 wherein said nominal-value signal deriving means includes a phase-shift circuit for bringing the nominal-value signal into phase with the time varying voltage at the input terminals.

11. A circuit as claimed in claim 9 wherein said up-converter further comprises a second control device having an input coupled to the input terminals and an output supplying a switching signal to the first switching transistor that is independent of a load voltage at said load terminals.

12. A circuit as claimed in claim 9 wherein said load terminals are connected to a high pressure electric discharge lamp.

13. A circuit as claimed in claim 9 wherein said nominal-value signal deriving means includes an RC circuit, and means for supplying a voltage developed across the second switching transistor to the RC circuit.

14. A circuit as claimed in claim 9 wherein said nominal-value signal deriving means comprises an opto-coupler unit having an input coupled to the input terminals and an output coupled to an RC circuit.

* * * * *